US009400092B2

(12) United States Patent
Wen

(10) Patent No.: US 9,400,092 B2
(45) Date of Patent: Jul. 26, 2016

(54) MULTIFUNCTIONAL EASY-TO-INSTALL LED LAMP

(71) Applicant: Debiao Wen, Guangdong (CN)

(72) Inventor: Debiao Wen, Guangdong (CN)

( * ) Notice: Subject to any disclaimer, the term of this patent is extended or adjusted under 35 U.S.C. 154(b) by 0 days.

(21) Appl. No.: 14/770,475

(22) PCT Filed: Mar. 21, 2013

(86) PCT No.: PCT/CN2013/072993

§ 371 (c)(1),
(2) Date: Oct. 14, 2015

(87) PCT Pub. No.: WO2014/131215

PCT Pub. Date: Sep. 4, 2014

(65) Prior Publication Data

US 2016/0040858 A1 Feb. 11, 2016

(30) Foreign Application Priority Data

Feb. 28, 2013 (CN) ..... 2013 1 0065141

(51) Int. Cl.
*F21V 17/00* (2006.01)
*F21V 17/18* (2006.01)
(Continued)

(52) U.S. Cl.
CPC . *F21V 17/18* (2013.01); *F21S 4/00* (2013.01); *F21S 8/02* (2013.01); *F21S 9/02* (2013.01); *F21V 23/023* (2013.01); *F21V 23/045* (2013.01); *F21Y 2101/02* (2013.01)

(58) Field of Classification Search
CPC ..... F21V 17/18; F21V 23/023; F21V 23/045; F21V 19/0045; F21V 19/003; F21V 19/0035; F21S 4/009; F21S 8/02; F21S 9/02; F21S 8/0033; F21S 8/04; F21S 8/043; F21S 9/022; F21Y 2101/02; F21K 9/30; F21K 9/50
USPC ..... 362/375, 147, 154, 155, 217.1, 217.14, 362/217.13, 217.17, 217.12, 217.16, 368, 362/374
See application file for complete search history.

(56) References Cited

U.S. PATENT DOCUMENTS

2009/0296390 A1* 12/2009 Dubord ..... B60Q 1/24 362/240
2010/0232164 A1* 9/2010 Tessnow ..... F21K 9/00 362/294

(Continued)

FOREIGN PATENT DOCUMENTS

| | | | |
|---|---|---|---|
| CN | 2937819 | Y | 8/2007 |
| CN | 201651991 | U | 11/2010 |
| CN | 102147094 | A | 8/2011 |
| CN | 202017972 | U | 10/2011 |

OTHER PUBLICATIONS

1st Office Action of counterpart Chinese Patent Application No. 201310065141.7 issued on Aug. 25, 2014.

*Primary Examiner* — Anh Mai
*Assistant Examiner* — Glenn D Zimmerman

(57) ABSTRACT

The present invention refers to a multifunctional easy-to-install LED lamp, including a lamp shade, a lamp body and a base. The lamp body includes a base plate, and an upper surface of the base plate is configured with a positioning bump and a locking bump. The base includes a bottom plate, and a lower surface of the bottom plate extends downwards to form a surrounding wall, which is constituted by a left wall, a front wall, a right wall and a back wall. A lower edge of the front wall extends towards the back wall to form a front hanging plate, a lower edge of the back wall extends towards the front wall to form a back hanging plate, the front hanging plate has a front gap for holding the locking bump, and the back hanging plate has a back gap for holding the locking bump.

9 Claims, 2 Drawing Sheets

(51) Int. Cl.

| | |
|---|---|
| ***F21S 4/00*** | (2016.01) |
| ***F21S 8/02*** | (2006.01) |
| ***F21S 9/02*** | (2006.01) |
| ***F21V 23/02*** | (2006.01) |
| ***F21V 23/04*** | (2006.01) |
| *F21Y 101/02* | (2006.01) |

(56) References Cited

U.S. PATENT DOCUMENTS

2011/0249427 A1* 10/2011 Rooms ..... F21S 8/026 362/147

2014/0092596 A1* 4/2014 Deutsch ..... F21S 4/28 362/236

* cited by examiner

MULTIFUNCTIONAL EASY-TO-INSTALL LED LAMP

TECHNICAL FIELD

This present invention refers to a structure of an LED lamp.

BACKGROUND

So far, an LED lamp widely used in places such as a parking lot or a stairway generally has an integrative structure, which causes inconvenient in installation and maintenance. For example, a special LED lamp used in a parking lot is disclosed in Chinese utility model patent 201120104517.7. Because the LED lamp is integrated, heavy and large, it has difficulties in holding and locating when the LED lamp is mounted on a ceiling or a wall, and the LED lamp has to be removed entirely when the LED lamp fails to work, which is very inconvenient.

SUMMARY OF THE INVENTION

The present invention provides a multifunctional easy-to-install LED lamp, which solves the difficulties in installation and maintenance. Particularly, the LED lamp is mounted conveniently in mass construction site. When maintenance occurs frequently, only a lamp shade and a lamp body are needed to be removed, and a base remains on the ceiling or the wall, which improves maintenance effectively.

Some embodiments of the present invention refer to:

A multifunctional easy-to-install LED lamp includes a lamp shade, a lamp body and a base, the lamp shade, the lamp body, the base are assembled from bottom to top in sequence; the lamp body includes a base plate, a PCB and an LED illumination module, the PCB is mounted on a lower surface of the base plate, the LED illumination module is mounted on the PCB, and an upper surface of the base plate is configured with a positioning bump and a locking bump; the base includes a bottom plate, a lower surface of the bottom plate extends downwards to form a surrounding wall, the surrounding wall is constituted by a left wall, a front wall, a right wall and a back wall, a lower edge of the front wall extends towards the back wall to form a front hanging plate, a lower edge of the back wall extends towards the front wall to form a back hanging plate, the front hanging plate has at least one front gap for holding the locking bump, the back hanging plate has at least one back gap for holding the locking bump; both ends of the locking bump are respectively hung on the front hanging plate and the back hanging plate; the positioning bump is coupled with the left wall, and the length of the positioning bump is shorter than a distance between the front hanging plate and the back hanging plate.

Preferably, for easily manufacturing, the at least one front gap is positioned opposite to the at least one back gap.

Preferably, for energy saving, the LED illumination module includes a primary LED illumination setting and an auxiliary LED illumination setting, a power of the primary LED illumination is higher than the one of the auxiliary LED illumination setting. Preferably, the PCB is further configured with a radar sensing switch, the primary LED illumination setting is connected to the power supply via the radar sensing switch. The PCB is further configured with: a charging circuit for charging a lithium battery while the power supply is accessible; an electricity selecting circuit for charging the auxiliary LED illumination setting with the power supply when the power supply is accessible, and charging the auxiliary LED illumination setting with the lithium battery when the power supply stops operating; the lithium battery is mounted on the lamp body.

Preferably, for a convenience in installation and maintenance, the base is configured with a power outlet, the PCB is connected to the power outlet via a power plug, the power outlet is connected to the power supply.

Preferably, for avoiding the lamp body sliding out of installation area in installation and removing, the upper surface of the base plate is configured with an anti-fall bump, the anti-fall bump is positioned between the locking bump and the right wall, the length of the anti-fall bump is shorter than a distance between the front hanging plate and the back hanging plate, a distance between the at least one front gap and the right wall is longer than a distance between the at least one front gap and the anti-fall bump. Preferably, the number of the locking bumps is two, the number of f the front gaps and the back gaps is separately two.

Preferably, the number of the locking bump, the front gap and the back gap is separately one, also, the front gap and the back gap are positioned staggeredly.

Beneficial effects of the present invention are as follows:

1. In installation, the base is mounted on a ceiling or a wall first, because the base has the front hanging plate, the back hanging plate, the at least one front gap and the at least one back gap, the lamp body has positioning bump and locking bump, the locking bump can slide along the front hanging plate or the back hanging plate after it inserts the at least one front gap and the at least one back gap. After the positioning bump is blocked by the surrounding wall of the base, both ends of locking bump are hung on the front hanging plate and back hanging plate, then the lamp shade, lamp body, the base are assembled fixedly by screws, and the installation is completed. It is very convenient.
2. In disassembly, lose screws, take the lamp shade down, then make the lamp body to slide along an opposite direction in installation. The locking bump can be taken out of the at least one front gap and the at least one back gap, and the removal is completed. It is convenient.
3. As the LED illumination module includes a auxiliary LED illumination setting, when the power supply operates properly, the auxiliary LED illumination setting remains lighting all the time, and supplying a dim light. When the power supply stops operating, the lithium battery supplies electricity to the auxiliary LED illumination setting, used as an emergency light.
4. when the radar sensing switch detects an entering of a person or a car, the primary LED illumination setting is lighten, which is energy saving and environmental protection.

wherein: 10, base; 101, left wall; 102, front wall; 1021, front hanging setting; 1022, front gap; 103, right wall; 104, back wall; 1041, back hanging plate; 1042, back gap; 105, bottom plate; 106, power outlet; 107 external power terminal; 108, screw hole; 20, lamp body; 201, positioning bump; 202, locking bump; 203, lithium battery; 204, power plug; 205, anti-fall bump; 206, base plate; 207, screw hole; 208, radar sensing switch; 2081, modulating button; 209, PCB; 2091, primary LED illumination setting; 2092, auxiliary LED illumination setting; 30, lamp shade; 301, screw hole; 40, screw.

DETAILED DESCRIPTION OF THE PREFERRED EMBODIMENTS

The present invention will be further described by referring to the accompanying drawings that illustrate the preferred embodiments of the invention.

As shown in FIGS. 1-6, a multifunctional easy-to-install LED lamp of this embodiment is illustrated by taking installation on a ceiling of a parking lot as an example. In this embodiment, the multifunctional easy-to-install LED lamp includes a lamp shade 30, a lamp body 20 and a base 10. The lamp shade 30, the lamp body 20 and the base 10 are assembled from bottom to top in sequence.

Figure 4:
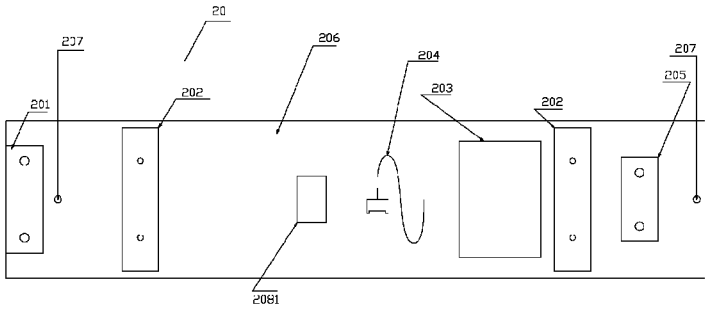
FIG. 4 shows a top view of the base of the LED lamp in FIG. 1.
Figure 5:
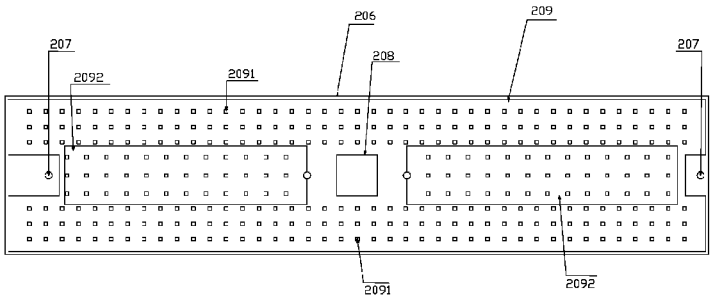
FIG. 5 shows a bottom view of the base of the LED lamp in FIG. 1.

As shown in FIG. 4 and FIG. 5, the lamp body 20 includes a base plate 206, a PCB 209, and an LED illumination module. The PCB 209 is mounted on a lower surface of the base plate 206. The LED illumination module is mounted on the PCB 209, and an upper surface of the base plate 206 is configured with a positioning bump 201, a locking bump 202 and an anti-fall bump 205.

The base plate 206 has screw holes 207 communicating with a lower surface and an upper surface thereof.

Wherein, the LED illumination module includes a primary LED illumination setting 2091 and a auxiliary LED illumination setting 2092. A power of the primary LED illumination setting 2019 is higher than the one of the auxiliary LED illumination setting 2092. Specifically, the power of the primary LED illumination setting 2091 is 15 W, and the power of the auxiliary LED illumination setting 2092 is 3 W. In this embodiment, both the primary LED illumination setting 2091 and the auxiliary LED illumination setting 2092 have corresponding constant current source driving circuits. The PCB 209 is further configured with a radar sensing switch 208. The primary LED illumination setting 2091 is connected to a power supply via the radar sensing switch 208. Generally, the radar sensing switch 208 has a distance sensing modulation function and a time-delay modulation function. A modulating button 2081 of the radar sensing switch 208 may be placed on the upper surface of the base plate 206. The upper surface of the base plate 206 is further configured with a power plug 204 electrically connected to the PCB 209. The PCB 209 is further configured with a charging circuit (not shown) for charging a lithium battery 203 when the power supply is accessible. An electricity selecting circuit (not shown) for charging the auxiliary LED illumination setting 2092 with the power supply when the power supply is accessible, and charging the auxiliary LED illumination setting 2092 with the lithium battery 203 when power supply stops operating. The lithium battery 203 is mounted on the lamp body 20, and specifically, on the upper surface of the base plate 206.

Figure 3:
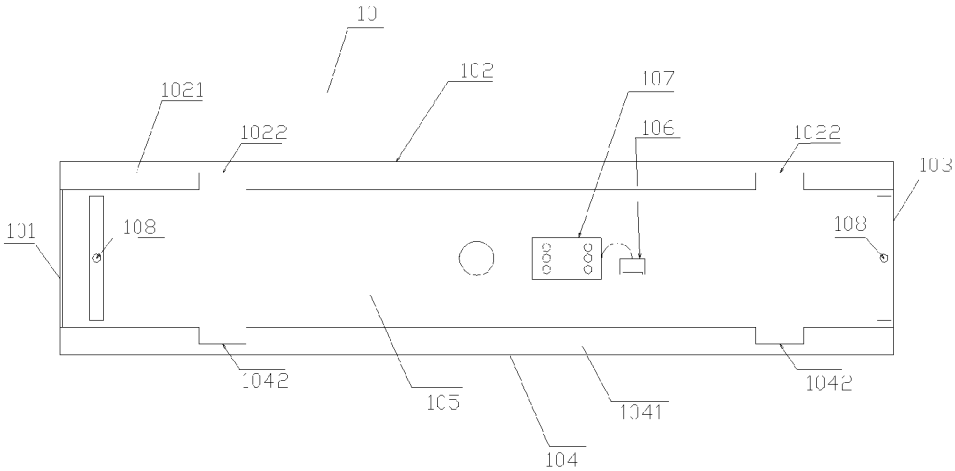
FIG. 3 is a bottom view of a base of the LED lamp in FIG. 1.

As shown in FIG. 3, The base 10 includes a bottom plate 105. A lower surface of the bottom plate 105 extends downwards to form a surrounding wall. The surrounding wall is constituted by a left wall 101, a front wall 102, a right wall 103 and a back wall 104. A lower edge of the front wall 102 extends towards the back wall 104 to form a front hanging plate 1021. A lower edge of the back wall 104 extends towards the front wall 102 to form a back hanging plate. The front hanging plate 1021 has a front gap 1022 for holding the locking bump 202. The hanging plate 1041 has a back gap 1045 for holding the locking bump 202. The front gaps 1022 are positioned opposite to the back gaps 1042. The bottom plate 105 further has screw holes 108 positioned corresponding to the screw holes 207 of the base plate 206.

Figure 6:
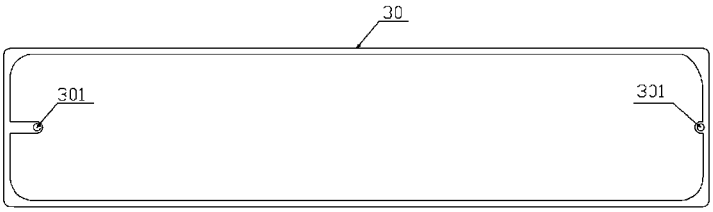
FIG. 6 shows a bottom view of a lamp shade of the LED lamp in FIG. 1.

As shown in FIG. 6, the lamp shade 30 is made of transparent plastic. Furthermore, the lamp shade 30 has screw holes 301 positioned corresponding to the screw holes 207 of the back plate 206.

In installation, both ends of the locking bump 202 are respectively hung on the front hanging plate 1021 and the back hanging plate 1041. In this embodiment, the locking bump 202 may preferably have a "T" shape structure. The positioning bump 201 is coupled with the left wall 101.

The length of the positioning bump 201 is shorter than a distance between the front hanging plate 1021 and the back hanging plate 1041.

The anti-fall bump 205 is positioned between the locking bump 202 and the right wall 103. The length of the anti-fall bump 205 is shorter than a distance between the front hanging plate 1021 and the back hanging plate 1041. A distance between the front gap 1022 and the right wall 103 is longer than a distance between the front gap 1022 and the anti-fall bump 205.

The base 10 is configured with a power outlet 106, the PCB 209 is connected to the power outlet 106 via the power plug 204, and the power outlet 106 is connected to the power supply via an external power terminal 107.

In this embodiment, the number of the locking bumps 202, the front gaps 1022 and the back gaps 1042 may be separately two.

Figure 1:
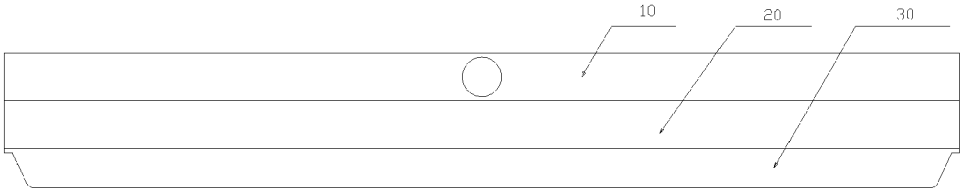
FIG. 1 is an assemble schematic diagram of the preferred embodiments of a multifunctional easy-to-install LED lamp.
Figure 2:
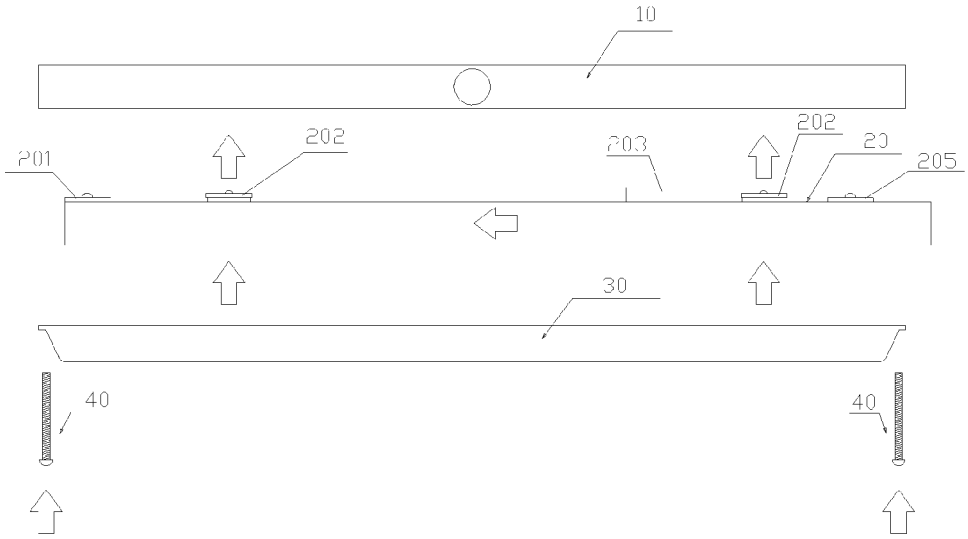
FIG. 2 is an exploded view of the LED lamp in FIG. 1, wherein the arrow direction shows the installation direction.

Installation process in this embodiment is as follows:

As shown in FIG. 2, the base 10 is mounted on a ceiling first, an external power supply cable is connected to the external power terminal 107, and then the lamp body 20 is raised to make the power plug 204 to connect with the power outlet 106. The locking bumps 202 insert the front gaps 1022 and the back gaps 1042, and slide towards left or right along the front hanging plate 1021 or the back hanging plate 1041. If the anti-fall bump 205 is blocked by the right wall 103 of the base 10, the lamp body 20 slides in an opposite direction until the positioning bump 201 is blocked by the left wall 101 of the base 10. You may loose your hands now, and both ends of locking bumps 202 are naturally hung on the front hanging plate 1021 and the back hanging plate 1041. The lamp shade 30, lamp body 20 and the base 10 are assembled fixedly by screws 40.

After finishing the installation, the power outlet 106 is connected to the power supply through the external power terminal 107. When the power supply operates properly, the auxiliary LED illumination setting 2092 remains lighting all the time, and supplying a dim light. When the power supply stops operating, the lithium battery 203 supplies electricity to the auxiliary LED illumination setting 2092 used as an emergency light. When a person, a car or other moving objects enter into an detection range of the radar sensing switch 208, the primary LED illumination setting 2019 is connected to the power supply, and the primary LED illumination setting 2091 is lighten in the delay time preseted by the radar sensing switch 208.

If the lamp body 20 is needed to be inspected, adjusted or maintained, the disassembling process is as follows:

Lose screws 40, take the lamp shade 30 down, and then make the lamp body 20 to slide along an opposite direction in installation. The locking bumps 202 can be taken out of the front gaps 1022 and the back gaps 1042. Draw the power plug 204 out from the power outlet 106. After the removal is completed, electronic devices in the lamp body 20 may be inspected, adjusted or maintained etc.

In order to improve tightness and aesthetic of the LED lamp, the base 10, the lamp body 20, the lamp shade 30 superpose on their projections on the ceiling respectively. The positioning bump 201 is positioned on a left edge of the base plate 206. There is a distance between the anti-fall bump 205 and the right edge of the base plate 206.

In addition, the number of the locking bump, the front gap, the back gap in the above embodiment may be separately one. The front gap and the back front gap are positioned staggeredly, and the locking bump has a "Z" shape structure correspondingly.

Various modifications could be made to the embodiments by those of ordinary skill in the art without departing from the true spirit and scope of the disclosure. And those modified embodiments are covered by the claims of the disclosure.

What is claimed is:

1. A multifunctional easy-to-install LED lamp, comprising:

a lamp shade, a lamp body and a base, wherein the lamp shade, the lamp body and the base are assembled from bottom to top in sequence; the lamp body comprises a base plate, a PCB and an LED illumination module, the PCB is mounted on a lower surface of the base plate, the LED illumination module is mounted on the PCB, and an upper surface of the base plate is configured with a positioning bump and a locking bump; the base includes a bottom plate, a lower surface of the bottom plate extends downwards to form a surrounding wall, the surrounding wall is constituted by a left wall, a front wall, a right wall and a back wall, a lower edge of the front wall extends towards the back wall to form a front hanging plate, a lower edge of the back wall extends towards the front wall to form a back hanging plate, the front hanging plate has at least one front gap for holding the locking bump, the back hanging plate has at least one back gap for holding the locking bump; both ends of the locking bump are respectively hung on the front hanging plate and the back hanging plate; the positioning bump is coupled with the left wall, and the length of the positioning bump is shorter than a distance between the front hanging plate and the back hanging plate.

2. The multifunctional easy-to-install LED lamp according to claim 1, wherein the at least one front gap is positioned opposite to the at least one back gap.

3. The multifunctional easy-to-install LED lamp according to claim 1, wherein the LED illumination module includes a primary LED illumination setting and an auxiliary LED illumination setting, the power of the primary LED illumination is higher than the one of the auxiliary LED illumination setting.

4. The multifunctional easy-to-install LED lamp according to claim 1, wherein the base is configured with a power outlet, the PCB is connected to the power outlet via a power plug, the power outlet is connected to the power supply.

5. The multifunctional easy-to-install LED lamp according to claim 1, wherein the upper surface of the base plate is configured with an anti-fall bump, the anti-fall bump is positioned between the locking bump and the right wall, the length of the anti-fall bump is shorter than a distance between the front hanging plate and the back hanging plate, and a distance between the at least one front gap and the right wall is longer than a distance between the at least one front gap and the anti-fall bump.

6. The multifunctional easy-to-install LED lamp according to claim 1, wherein the number of the locking bumps is two, the number of the front gaps and the back gaps is separately two.

7. The multifunctional easy-to-install LED lamp according to claim 1, wherein the number of the locking bump, the front gap and the back gap is separately one, the front gap and the back gap are positioned staggeredly.

8. The multifunctional easy-to-install LED lamp according to claim 3, wherein the PCB is configured with a radar sensing switch, the primary LED illumination setting is connected to the power supply via the radar sensing switch.

9. The multifunctional easy-to-install LED lamp according to claim 3, wherein the PCB is configured with a charging circuit for charging a lithium battery while the power supply is accessible; an electricity selecting circuit for charging the auxiliary LED illumination setting with the power supply when the power supply is accessible, and charging the auxiliary LED illumination setting with the lithium battery when the power supply stops operating; the lithium battery is mounted on the lamp body.

* * * * *